US007244179B2

(12) United States Patent
Chien

(10) Patent No.: US 7,244,179 B2
(45) Date of Patent: Jul. 17, 2007

(54) SUSPENSION TYPE OSCILLATION MECHANISM

(76) Inventor: Hung-Chi Chien, Rm. 4C 26, No. 5, Hsinyi Rd., Sec. 5, Taipei (TW)

( * ) Notice: Subject to any disclaimer, the term of this patent is extended or adjusted under 35 U.S.C. 154(b) by 234 days.

(21) Appl. No.: 11/057,785

(22) Filed: Feb. 15, 2005

(65) Prior Publication Data

US 2006/0199522 A1 Sep. 7, 2006

(30) Foreign Application Priority Data

Feb. 4, 2005 (TW) ..... 94202202 U

(51) Int. Cl.
*F24F 7/06* (2006.01)
*F04D 25/10* (2006.01)
*F04D 25/02* (2006.01)

(52) U.S. Cl. ..... 454/230; 454/228; 454/285; 416/100; 416/244 R

(58) Field of Classification Search ..... 454/125, 454/153, 285, 228, 230, 251; 416/79, 100, 416/108, 110, 244 R
See application file for complete search history.

(56) References Cited

U.S. PATENT DOCUMENTS 1,480,721 A * 1/1924 Glasser ..... 416/100
2,765,977 A * 10/1956 Morrison ..... 417/359
2,808,198 A * 10/1957 Morrison ..... 74/48
3,072,321 A * 1/1963 King, Jr. ..... 415/70
3,945,769 A * 3/1976 Sanderson ..... 417/361
4,486,144 A * 12/1984 Hung ..... 415/121.2
4,703,152 A * 10/1987 Shih-Chin ..... 392/366
2003/0064678 A1* 4/2003 Terrell et al. ..... 454/337
2004/0191065 A1* 9/2004 Chen ..... 416/210 R
2004/0191066 A1* 9/2004 Chen ..... 416/210 R

* cited by examiner

*Primary Examiner*—Kenneth B. Rinehart
*Assistant Examiner*—Patrick F. O'Reilly, III
(74) *Attorney, Agent, or Firm*—Troxell Law Office, PLLC

(57) ABSTRACT

A suspension type oscillation mechanism including a frame set having an upper frame with a frame hole, a casing secured to the frame set, a crank set, an axial barrel and a fastening rod. The crank set has cranks rotationally joining to each other and an end of the initial one of the cranks is connected to an output shaft of a motor eccentrically. The axial barrel is inserted into the frame hole and the casing hole. A bearing seat having an inner bearing pressed by an end of the axial barrel. The fastening rod set has a screw rod passing through a suspended article and the axial barrel. An upper end of the screw rod is connected to the crank set and the lower end is connected to the suspended article by a rod seat and a collar located on a top of the suspended article.

5 Claims, 3 Drawing Sheets

SUSPENSION TYPE OSCILLATION MECHANISM

FIELD OF THE INVENTION

Taking a cold-air or hot-air casing body as an example, the conventional way is to provide an upright frame attached with a cold-air or hot-air casing body and a crank is driven by an eccentric shaft of a motor. Then, the crank actuates a pivot to allow the cold or hot air casing body rotating to and fro in a preset angular distance.

BACKGROUND OF THE INVENTION

Rotational mechanisms are frequently seen in our daily life being operated in different ways. Conventional cooling fan or hot-air fan can rotate to and fro in a preset angular distance. On the other hand, a stationary article being suspended is frequently used. The reason of the preceding arrangement is to accommodate the environment.

Taking a cold-air or hot-air casing body as an example, the conventional way is to provide an upright frame attached with a cold-air or hot-air casing body and a crank is driven by an eccentric shaft of a motor. Then, the crank actuates a pivot to allow the cold or hot air casing body rotating to and fro in a preset angular distance.

Although the preceding structure can perform basic rotational function, the deficiency of the conventional way resides in that the cold or hot air casing body moves over the space surrounded by the frame such that a space available for rotation of the casing body has to be reserved in advance. Besides, movement at an open space often creates some problems concerning safety.

SUMMARY OF THE INVENTION

In order to overcome the shortcomings resulting from the preceding conventional rotational mechanism, the present invention provides a suspension type oscillation mechanism, which includes a frame set, a casing, a crank set, an axial barrel and a fastening rod. The frame set provides an upper frame with a frame hole. The casing secures the frame set. The crank set provides cranks rotationally joining to each other and an end of the initial one of the cranks is connected to an output shaft of a motor eccentrically. The axial barrel is cylindrical with a size less than the frame hole and the casing hole and an end thereof is joined to a crank hole of the terminal one of the cranks. A bearing seat is secured to the casing and provides an inner bearing pressed by another end of the axial barrel. The fastening rod set is a screw rod with both ends extending outward a suspended article after passing through the suspended article and the axial barrel for being fastened with nuts in a way of a collar extending from the top of the suspended article pressing against the inner bearing. Hence, output of the motor drives the suspended article to oscillate in a preset angular distance.

BRIEF DESCRIPTION OF THE DRAWINGS

The present invention can be more fully understood by reference to the following description and accompanying drawings, in which.

DETAILED DESCRIPTION OF THE INVENTION

The preferred embodiment of a suspension type oscillation mechanism according to the present invention is implemented to a hot-air fan such as a ceramic heating type hot-air fan, a fan such as a cool fan or an ordinary fan, an air cleaner, lighting device, video device, monitor and etc.

Figure 1:
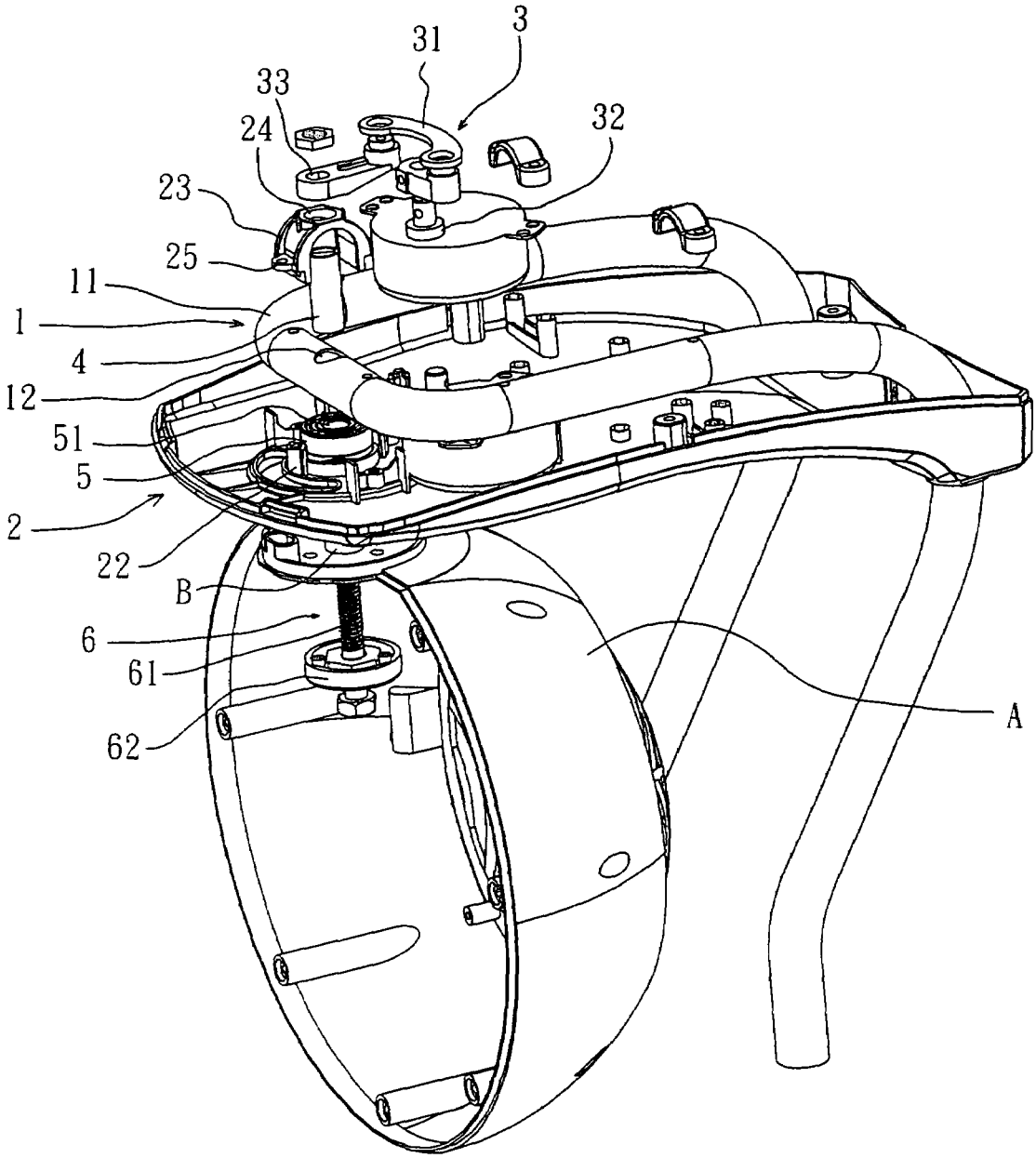
FIG. 1 is an exploded perspective view of a suspension type oscillation mechanism according to the present invention.
Figure 2:
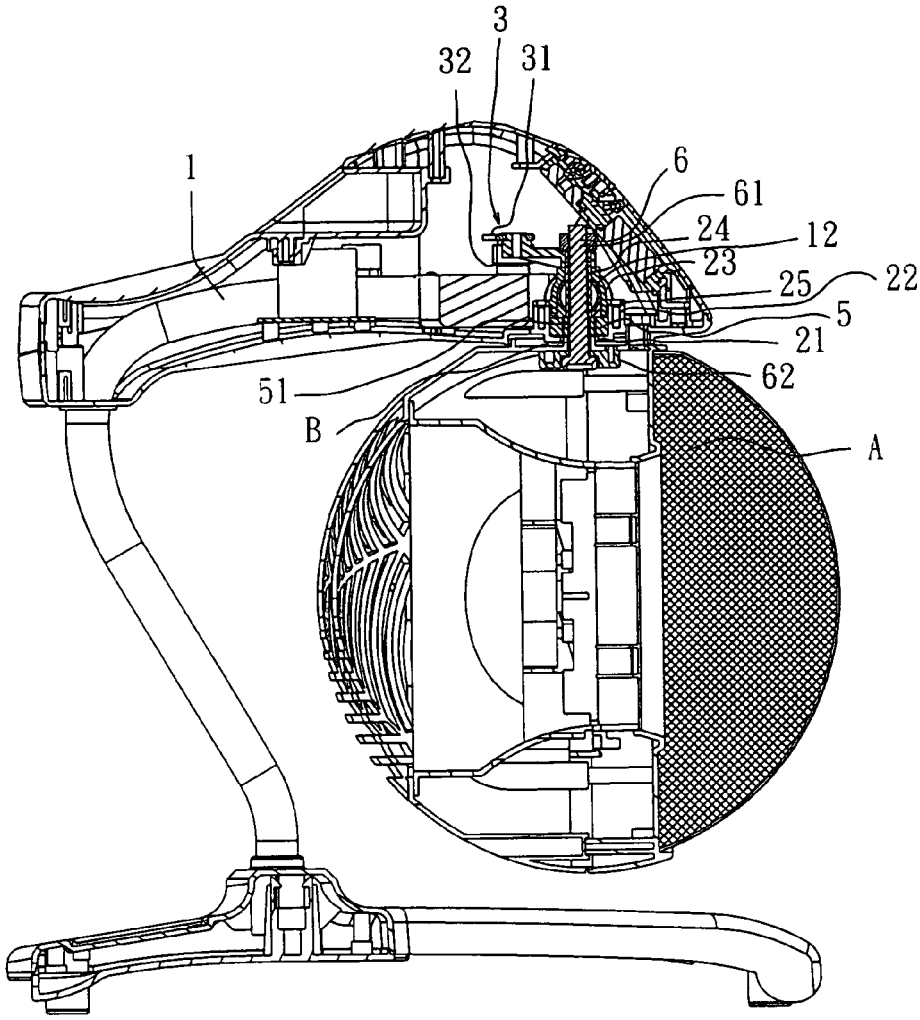
FIG. 2 is a sectional view of the suspension type oscillation mechanism according to the present invention.
Figure 3:
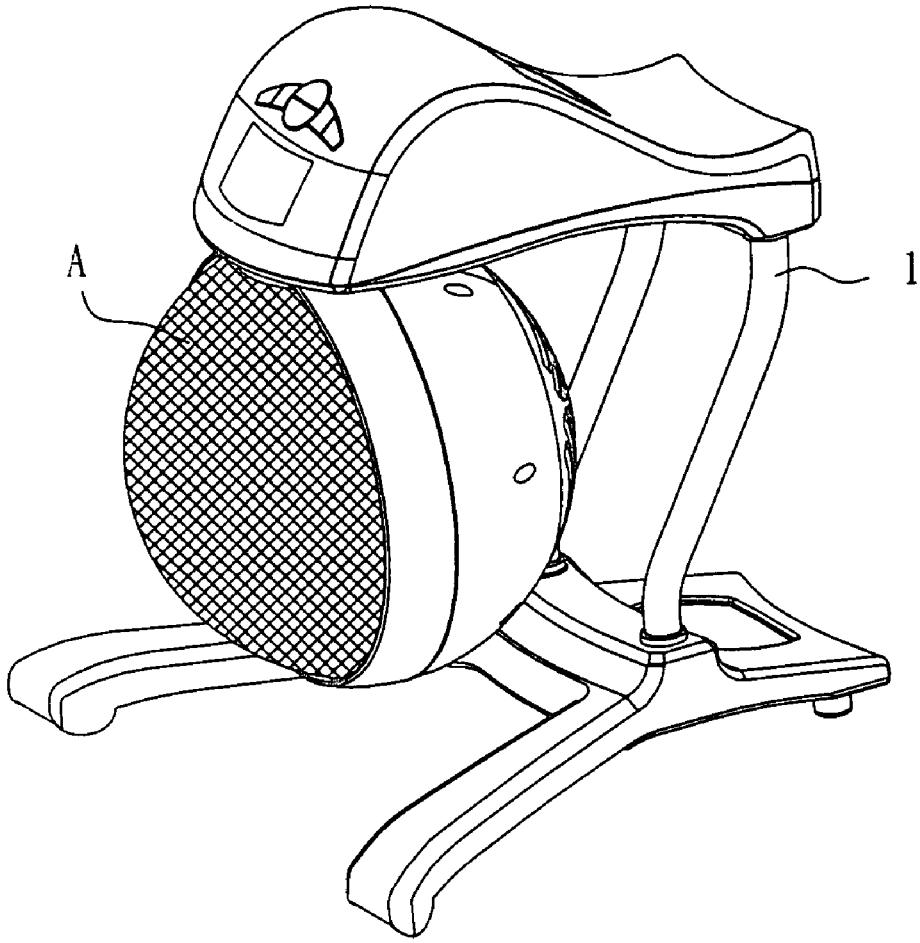
FIG. 3 an assembled perspective view of the suspension type oscillation mechanism according the present invention.

Referring to FIGS. 1 to 3, basically, the suspension type oscillation mechanism according to the present invention includes a frame set 1, a casing 2, a crank set 3, an axial barrel 4, a bearing seat 5 and a fastening rod set 6.

The frame set 1 is a support frame and a hung article A can be confined in a space surrounded by the frame set 1. In order to be capable of hanging articles, the frame set 1 has an upper frame 11 with a frame hole 12 for being passed through with the axial barrel 4 and the fastening rod set 6.

The casing 2, to which the bearing 5 and the fastening rod 6 is secured, provides a casing hole 21 corresponding to the axial barrel 4 and has a perforated casing post 22 and a post cover 23 at two sides thereof for confining and locating the upper frame 11. The post cover 23 has a cover hole 24 at the center thereof for the axial barrel 4 passing through and has a post hole 25 at both lateral sides thereof for engaging with the holes of the casing post 22. This is one of ways to confine the upper frame 11 between the post cover 23 and the casing 22. It is noted that other equivalent ways can be used too.

The crank set 3 is attached to the casing 2 and provides a plurality of cranks joining each other to connect with an output shaft 32 of an eccentric motor such that the crank set 3 swings to and fro in an angular distance while the motor rotates. Because this is conventional art, no detail will described further. The crank 31 at the output end has a non-circular crank hole 33 for fitting with the axial barrel 4.

The axial barrel 4 is cylindrical and has a size corresponding to the frame hole 12 and the casing hole 21 and passes through the frame hole 12 and with a little interference. During assembling, the upper end of the axial barrel 4 is located at the crank hole 33 and the lower end thereof closely contacts with an inner bearing 51 of the bearing seat 5.

The bearing seat 5 is secured to the casing 2 with the inner bearing 51 being pressed by the axial barrel 4.

The fastening rod set 6 has a screw rod 61 and a rod seat 62 and passes through the axial barrel 4. The lower end of the fastening rod set 6 passes through and engages with the suspended article A and the upper end thereof has a size corresponding to the crank hole 33 so as to engage with the crank hole 33 with a nut. Thus, the fastening rod set 6 with the suspended article A is driven by the crank set 3 to perform oscillation movement. The suspended article A tightly presses against the bottom of the inner bearing 51 with a collar B extending from the top thereof oscillate after the suspension type oscillation mechanism is completely assembled as shown in FIG. 3.

Referring to FIGS. 1 to 3, the upper frame 11 is located at the casing 2 and the axial barrel 4 passes through the cover hole 24 and the frame hole 12 before pressing against the inner bearing 51. The screw rod 61 of the fastening rod assembly 6 passes through the suspended article A and the axial barrel 4 from the bottom and the upper end thereof is inserted into the crank hole 33 and secured with a nut. The extended collar B of the suspended article A presses against the bottom of the inner bearing 51 tightly so that the suspended article A can swing to and fro in a preset angular distance so as to form the suspension type oscillation mechanism.

While the suspension type oscillation mechanism according to the present invention is in operation, once the motor is started, output of the crank set 3 is swing to and fro in a preset angular distance to actuate the screw rod 61 so that the suspended article A can swing to and fro in a preset angular distance with respect to the frame set 1.

It is appreciated that the suspended article A oscillating with a preset angular distance in the frame set 1 is a type of oscillation confined in the frame set 1 by way of suspending and it is a novel structure among articles in the same class.

While the invention has been described with reference to the a preferred embodiment thereof, it is to be understood that any modifications or variations which without departing from the spirit of this invention defined by the appended claims, are still within the scope of the protection of the present invention.

What is claimed is:

1. A suspension type oscillation mechanism comprising:

a) a suspended article;

b) a frame set having an upper frame having a frame hole;

c) a casing connected to the frame set and having a casing hole;

d) a crank set having a plurality of cranks, each of the plurality of cranks is pivotally connected at an end thereof to an end of an adjacent one of the plurality of cranks, a first end crank of the plurality of cranks is eccentrically connected to an output shaft of a motor, a second end crank of the plurality of cranks has a non-circular crank hole;

e) an axial barrel having a cylindrical shape and inserted through the frame hole of the upper frame and the casing hole of the casing;

f) a bearing set connected to the casing and having an inner bearing, the axial barrel having a first end pressing against the inner bearing and a second end pressing against the second end crank at the non-circular crank hole;

g) a fastening rod set having a screw rod and a rod seat, the screw rod is inserted through the axial barrel and connected at a first end to the suspended article and at a second end to the second end crank, the rod seat is located in an interior of the suspended article and connected to the first end of the screw rod; and h) a collar, the suspended article is secured to the fastening rod between the rod seat and the collar, wherein an output of the motor drives the suspended article to oscillate a predetermined distance.

2. The suspension type oscillation mechanism according to claim 1, wherein the casing includes two perforated casing posts and a post cover having two post holes and a cover hole, one of the two post holes is located on each of two opposing sides of the post cover, the axial barrel is inserted through the cover hole of the post cover, the two perforated casing posts are aligned with the two post holes and connected to the post cover connecting the casing to the upper frame.

3. The suspension type oscillation mechanism according to claim 1, wherein the suspended article is selected from a group consisting of a cooling fan, a hot-air fan, and an air cleaner.

4. The suspension type oscillation mechanism according to claim 1, wherein the suspended article is surrounded by the frame set.

5. The suspension type oscillation mechanism according to claim 1, wherein the screw rod has a non-threaded portion located in the rod seat.

* * * * *